US010436459B2

(12) United States Patent
Jeon

(10) Patent No.: US 10,436,459 B2
(45) Date of Patent: Oct. 8, 2019

(54) AIR GUIDE FOR AIR CONDITIONER

(71) Applicant: LG ELECTRONICS INC., Seoul (KR)

(72) Inventor: Boohwan Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 191 days.

(21) Appl. No.: 15/221,298

(22) Filed: Jul. 27, 2016

(65) Prior Publication Data

US 2017/0159949 A1 Jun. 8, 2017

(30) Foreign Application Priority Data

Dec. 8, 2015 (KR) ..... 10-2015-0173988

(51) Int. Cl.

| | |
|---|---|
| ***F24F 1/22*** | (2011.01) |
| ***F24F 13/08*** | (2006.01) |
| ***F24F 13/20*** | (2006.01) |
| ***F24F 1/24*** | (2011.01) |
| ***F24F 1/36*** | (2011.01) |
| ***F24F 1/48*** | (2011.01) |

(52) U.S. Cl.

CPC ..... *F24F 1/22* (2013.01); *F24F 1/24* (2013.01); *F24F 1/36* (2013.01); *F24F 1/48* (2013.01); *F24F 13/08* (2013.01); *F24F 13/20* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,664,428 A * | 9/1997 | Sugiyama | ..... | F24F 1/0007 62/259.1 |
| 8,763,416 B2 * | 7/2014 | Hika | ..... | F24F 1/22 312/100 |
| 2006/0053818 A1 * | 3/2006 | Yoshida | ..... | F28F 17/005 62/285 |

FOREIGN PATENT DOCUMENTS

| | | | | |
|---|---|---|---|---|
| CN | 102997345 B | 9/2015 | | |
| EP | 2244024 A1 * | 10/2010 | ..... | F24F 1/20 |
| EP | 2 481 994 A1 | 8/2012 | | |
| GB | 2304400 A * | 3/1997 | ..... | F24F 1/22 |
| JP | 2004-239532 A | 8/2004 | | |
| JP | 2006-84106 A | 3/2006 | | |
| JP | 2008-157587 A | 7/2008 | | |
| JP | 2010-210173 A | 9/2010 | | |
| JP | 2013-50255 A | 3/2013 | | |
| JP | 5482780 B2 | 5/2014 | | |
| JP | 2015-55465 A | 3/2015 | | |
| KR | 20-1998-0021307 U | 7/1998 | | |
| KR | 10-2001-0095740 A | 11/2001 | | |

* cited by examiner

*Primary Examiner* — Gregory L Huson
*Assistant Examiner* — Elizabeth M. May
(74) *Attorney, Agent, or Firm* — Dentons US LLP

(57) ABSTRACT

An air conditioner includes an air guide which guides external air from an electronic component chamber to a heat exchange chamber, wherein the air guide includes a guide body which forms an air path; a water collection part which stores water introduced into the guide body; and a drainage hole of the water collection part which is provided at the water collection part to discharge the water.

16 Claims, 15 Drawing Sheets

AIR GUIDE FOR AIR CONDITIONER

CROSS-REFERENCE TO RELATED APPLICATION

This application claims priority under 35 U.S.C. § 119 and 35 U.S.C. § 365 to Korean Patent Application No. 10-2015-0173988, filed on Dec. 8, 2015, which is hereby incorporated by reference.

BACKGROUND

1. Field

An air guide for an air conditioner is disclosed herein.

2. Background

An air conditioner is a home appliance which maintains indoor air in an optimal state according to intended uses and purposes thereof. The air conditioner may include an indoor unit and an outside unit. The air conditioner may be a separated type air conditioner in which an indoor unit and an outside unit are separated from each other, or an integrated type air conditioner in which the indoor unit and the outside unit are integrated in one unit.

The air conditioner drives a refrigeration cycle. The refrigeration cycle generally includes a compressor to compress a refrigerant, a condenser to condense the compressed refrigerant, an expander to expands the condensed refrigerant, and an evaporator to evaporate the expanded refrigerant.

The outside unit may include the compressor, an outside heat exchanger, and a plurality of electronic components. The electronic components control the refrigeration cycle. The electronic components may include a component which generates a lot of heat. When such component is not operated at an operable temperature, the refrigeration cycle is inefficiently driven, or the air conditioner may be damaged.

Korean Patent Application No. 10-2000-0019054, titled "Air Guide Device of Air Conditioner," which is incorporated herein by references, discloses a conventional method and configuration in which some of the air flowing inside of the outside unit may pass through a space where the electronic components are arranged. The electronic components are cooled by the air that passes by them. However, according to such configuration, when the outside unit is installed at an outside space, and exposed to moisture such as snow and rain, the moisture may be introduced into the outdoor unit along with external air introduced into a heat exchanger. Also, when the air conditioner performs a cooling operation, condensate water may be generated in the outside unit due to heat exchange. Therefore, when the water permeates into an installation space of the electronic components, the electronic components may be damaged and/or cause a fire due to a short circuit.

Accordingly, to satisfy at least the above described problems of the conventional configuration, an air path should be disposed in the outside unit such that the air is smoothly circulated to the electronic components so as to cool the electronic components, and water should be prevented from permeating into the air path. In other words, a structure that provides the path having a flow speed over a certain level and also prevents water from permeating into an electronic component chamber, is required.

SUMMARY

The present disclosure is directed to providing an air guide which prevents water permeation.

Also, the present disclosure is directed to providing an air guide which enables a flow speed of air for cooling an electronic component part to be increased.

Also, the present disclosure is directed to providing an air guide which enables the air adjacent to a heat generating device to be intensively discharged. According to an aspect of the invention, an air conditioner includes a case having a heat exchange chamber and an electronic component chamber formed at a side of the heat exchange chamber, the electronic component chamber having an electronic component part disposed therein; a suction port provided at the case and through which air that is external to the air conditioner is introduced inside the case; and an air guide attached to the electronic component part to guide the air introduced through the suction port from the electronic component chamber to the heat exchange chamber, wherein the air guide includes a guide body to form an air path, a water collection part provided at a lower portion of the guide body to store water introduced into the guide body, and a drainage hole provided at the water collection part to discharge the water.

According to another aspect of the invention, an conditioner further includes an outside unit discharge port which is provided at the case and forms a first discharge surface for discharging air in the heat exchange chamber, and an air guide discharge port which is provided at the air guide and forms a second discharge surface for discharging air in the electronic component chamber, wherein the first discharge surface and the second discharge surface intersect at a preset angle.

According to yet another aspect of the invention, an conditioner further includes an outside unit discharge port which is provided at the case and forms a first discharge surface for discharging air in the heat exchange chamber, and an air guide discharge port which is provided at the air guide and forms a second discharge surface for discharging air in the electronic component chamber, wherein the first discharge surface and the second discharge surface intersect at a preset angle of 45° to 70°.

The details of one or more embodiments are set forth in the accompanying drawings and the description below. Other features will be apparent from the description and drawings, and from the claims.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION

Reference will now be made in detail to the embodiments of the present disclosure, examples of which are illustrated in the accompanying drawings. It is understood that the description herein is not intended to limit the claims to the specific embodiments described. On the contrary, it is intended to cover alternatives, modifications, and equivalents as may be included within the spirit and scope of the present disclosure.

Figure 1:
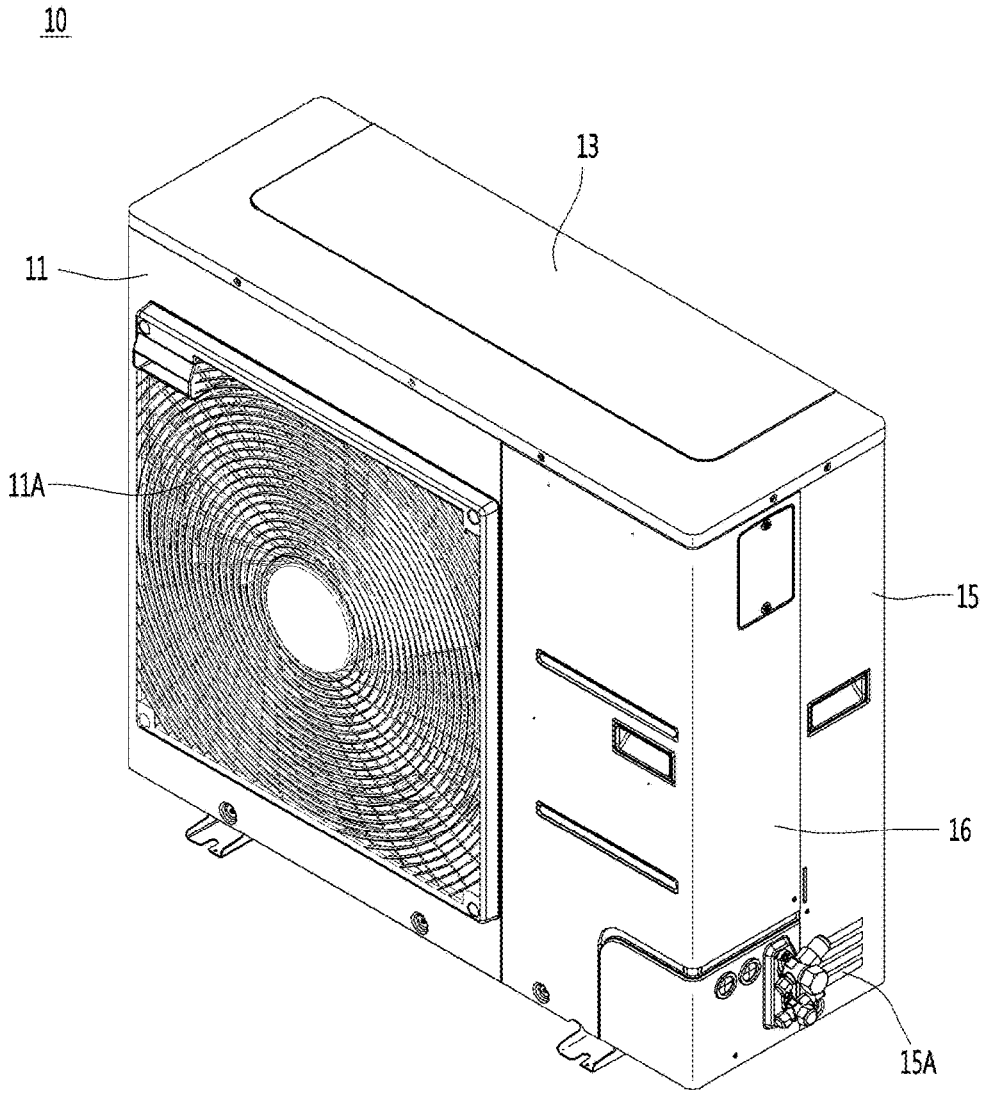
FIG. 1 is a perspective view of an outside unit of an air conditioner according to an embodiment of the present disclosure.
Figure 2:
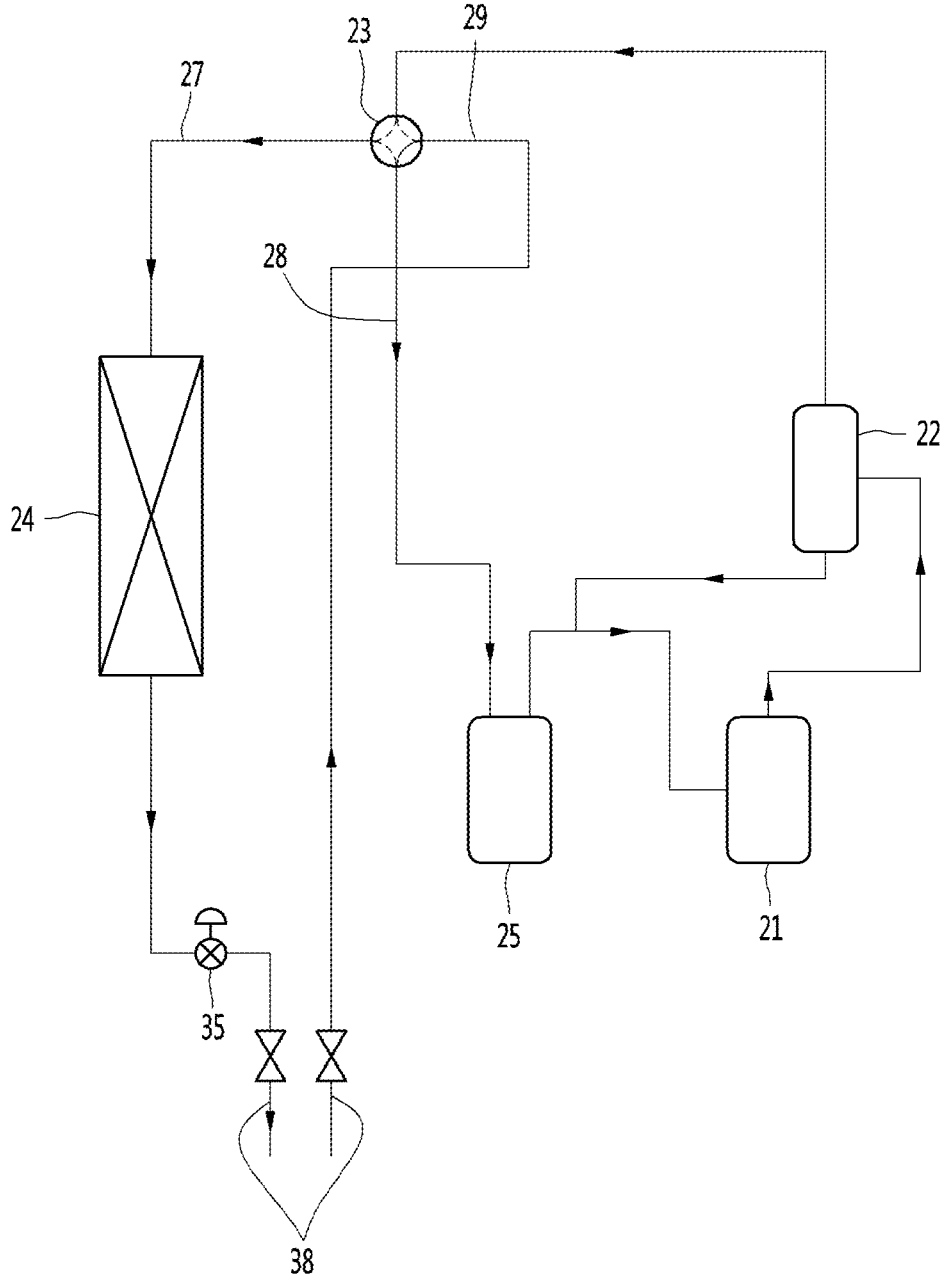
FIG. 2 is shows a flow of a refrigerant of an air conditioner according to an embodiment of the present disclosure.
Figure 3:
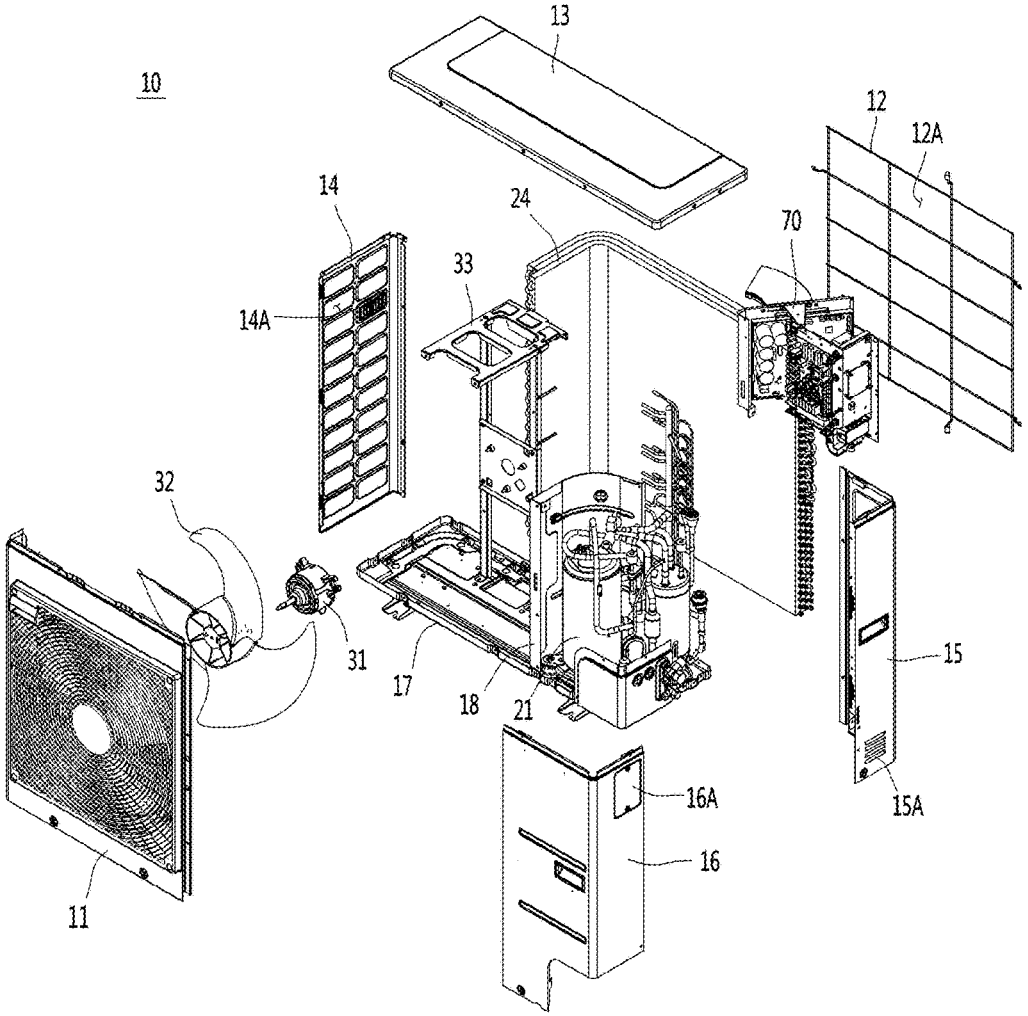
FIG. 3 is an exploded view of the outside unit of the air conditioner according to an embodiment of the present disclosure.
Figure 4:
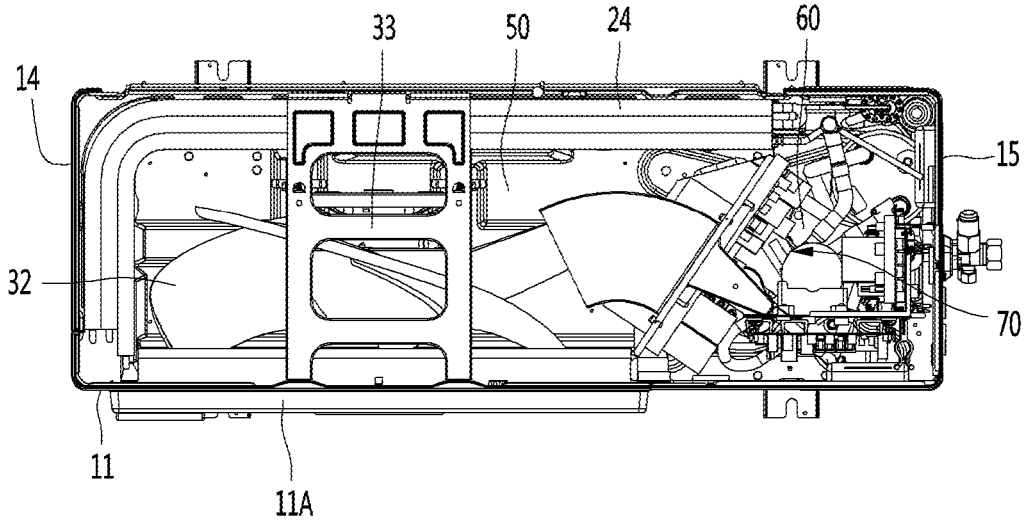
FIG. 4 is a top view illustrating a state in which an upper surface panel is removed from the outside unit of the air conditioner according to an embodiment of the present disclosure.

FIG. 1 is a perspective view of an outside unit of an air conditioner according to an embodiment of the present disclosure, FIG. 2 illustrates a flow of a refrigerant and a configuration of the air conditioner according to the embodiment of the present disclosure, FIG. 3 is an exploded view of the outside unit of the air conditioner according to the embodiment of the present disclosure, and FIG. 4 is a top view illustrating a state in which an upper surface panel is removed from the outside unit of the air conditioner according to the embodiment of the present disclosure.

Referring to FIGS. 1 through 4, an air conditioner includes an outside unit 10 which exchanges heat with outside air, and an indoor unit (not shown) which is disposed at an indoor space to condition indoor air.

The outside unit 10 includes a case which forms an exterior and in which a plurality of components are installed. The case includes a front panel 11 which forms a front surface of the outside unit 10, a rear panel 12 spaced apart from the front panel 11, an upper surface panel 13 that forms an upper surface of the outside unit 10, and a left panel 14 and a right panel 15 that form both side surfaces of the outside unit 10. The front panel 11 may include a discharge port 11A. The rear panel 12 may include a suction port 12A. The left and right panels 14 and 15 may include suction ports 14A and 15A, respectively.

The outside unit 10 includes an internal space surrounded by the case, and a compressor or the like which will be described later may be disposed inside the internal space.

The outside unit 10 may include the suction ports 12A, 14A and 15A through which the outside air is suctioned, and the discharge port 11A through which the suctioned air is discharged. The discharge port 11A may be formed at a front of the case, and the suction ports 12A, 14A and 15A may be formed at a rear or a side of the case. More specifically, the discharge port 11A may be located at the front panel 11, and the suction ports 12A, 14A and 15A may be located on at least one of the rear panel 12, the left panel 14, and the right panel 15.

The outside unit 10 may further include a service panel 16. The service panel 16 may be rounded from the front surface of the outside unit 10 toward one side surface thereof.

For example, the service panel 16 may be formed to be rounded from the front surface of the outside unit 10 toward a right side surface thereof. One end of the service panel 16 may be attached to a right end of the front panel 11, and the other end of the service panel 16 may be attached to a front end of the right panel 15. Accordingly, because the service panel 16 may open and close the front and the side together with one panel, an installer or manager's access to an electronic component chamber may be made easier.

The service panel 16 may include a service window and a service cover 16A. The service window is an opening which passes through the service panel 16, and may be formed to correspond to a display PCB 72. Thus, because the display PCB 72 is exposed to an outside through the service window, the installer may check a state of the outside unit 10 without completely disassembling or removing the service panel 16.

The service window may be provided at the side surface of the outside unit 10. For example, the service window may be provided at a right side surface of the service panel 16.

The outside unit 10 may further include a base 17 which forms a lower surface of the outside unit 10. The compressor or the like may be installed on an upper surface of the base 17. A lower surface of the base 17 may be in contact with a ground surface, and thus the outside unit 10 may be fixed to the ground.

The outside unit 10 may include a partition wall 18 which extends upward from the base 17. The partition wall 18 may divide the internal space into a heat exchange chamber 50 and an electronic component chamber 60. The partition wall 18 functions to prevent water in the heat exchange chamber 50 from permeating into the electronic component chamber 60.

The heat exchange chamber 50 is a space in which a heat exchanger 24 and a fan 32 may be disposed and in which heat is exchanged between a refrigerant passing through the heat exchanger 24 and external air flowing by the fan 32. The electronic component chamber 60 is a space in which an electronic component part 70 may be located. The electronic component part 70 may be provided at an upper portion of the electronic component chamber 60 to prevent water permeation.

The partition wall 18 may be a plate which extends vertically, and one end thereof may be coupled to the upper surface of the base 17, and the other end thereof may be coupled to a first panel 80 which will be described later. The partition wall 18 may include a curved surface which is formed to be rounded. The partition wall 18 may have the curved surface corresponding to a configuration which is disposed at the electronic component part 70.

A compressor 21, an oil separator 22, a flow switching part 23, an outside heat exchanger 24, an expansion valve 35, a gas-liquid separator 25, and a plurality of refrigerant pipes may be provided inside the case.

The outside unit 10 includes the compressor 21 which compresses the refrigerant, and the oil separator 22 which may be disposed at an outlet side of the compressor 21 to separate oil from the refrigerant discharged from the compressor 21.

The flow switching part 23 which guides the refrigerant discharged from the compressor 21 toward the outside heat exchanger 24 or the indoor unit (not shown) may be provided at an outlet side of the oil separator 22. For example, the flow switching part 23 may include a 4-way valve.

The flow switching part 23 may be connected to a first connection pipe 27 which may be connected to the outside heat exchanger 24, a second connection pipe 28 which may be connected to the gas-liquid separator 25, and a third connection pipe 29 which may be connected to the indoor unit (not shown).

Thus, according to an embodiment of the disclosure, when the air conditioner performs a cooling operation, the refrigerant is introduced from the flow switching part 23 into the outside heat exchanger 24 through the first connection pipe 27. However, when the air conditioner performs a warming operation, the refrigerant is introduced from the flow switching part 23 into an indoor heat exchanger of the indoor unit (not shown) through the third connection pipe 29.

In the outside heat exchanger 24, heat is exchanged between the external air and the refrigerant, and the outside heat exchanger 24 functions as the condenser when the air conditioner performs the cooling operation, and also functions as the evaporator when the air conditioner performs the warming operation.

When the air conditioner performs the cooling operation, the refrigerant passed through the outside heat exchanger 24 passes through the expansion valve 35. That is, the expansion valve 35 may be disposed at an outlet side of the outside heat exchanger 24 based on the cooling operation. When the cooling operation is performed, the main expansion valve 35 may be completely opened, and thus a decompressing action of the refrigerant is not performed.

The refrigerant passed through the expansion valve 35 may flow to the indoor unit through an indoor pipe 38. The refrigerant evaporated in the indoor heat exchanger may be introduced into the outside unit 10 through the indoor pipe 38.

The refrigerant introduced into the indoor unit may be introduced into the flow switching part 23 through the third connection pipe 29, and discharged from the flow switching part 23 through the second connection pipe 28.

The refrigerant passed through the flow switching part 23 may flow to the gas-liquid separator 25. The gas-liquid separator 25 may separate a gas refrigerant before the refrigerant is introduced into the compressor 21, and the separated gas refrigerant may be introduced into the compressor 21.

The outside unit 10 may further include a motor 31, the fan 32, and a motor bracket 33.

The motor 31 may function to provide a rotating force to the fan 32. For example, the fan 32 may be attached to a rotating shaft of the motor 31, thus causing the air to flow by the rotating force. The fan 32 may be attached to the motor bracket 33. The motor bracket 33 may support both the motor 31 and the fan 32.

The fan 32 may be disposed in a location corresponding to the discharge port 11A provided at the front panel 11. The motor bracket 33 may be disposed between the base 17 and the upper surface panel 13. In other words, one end thereof may be attached to the upper surface of the base 17, and the other end thereof may be attached to a lower surface of the upper surface panel 13, and the motor 31 attached to the front surface may be located corresponding to the discharge port 11A. A discharge port 103 of an air guide 100 may be located at an upper side of the fan 32.

Figure 5:
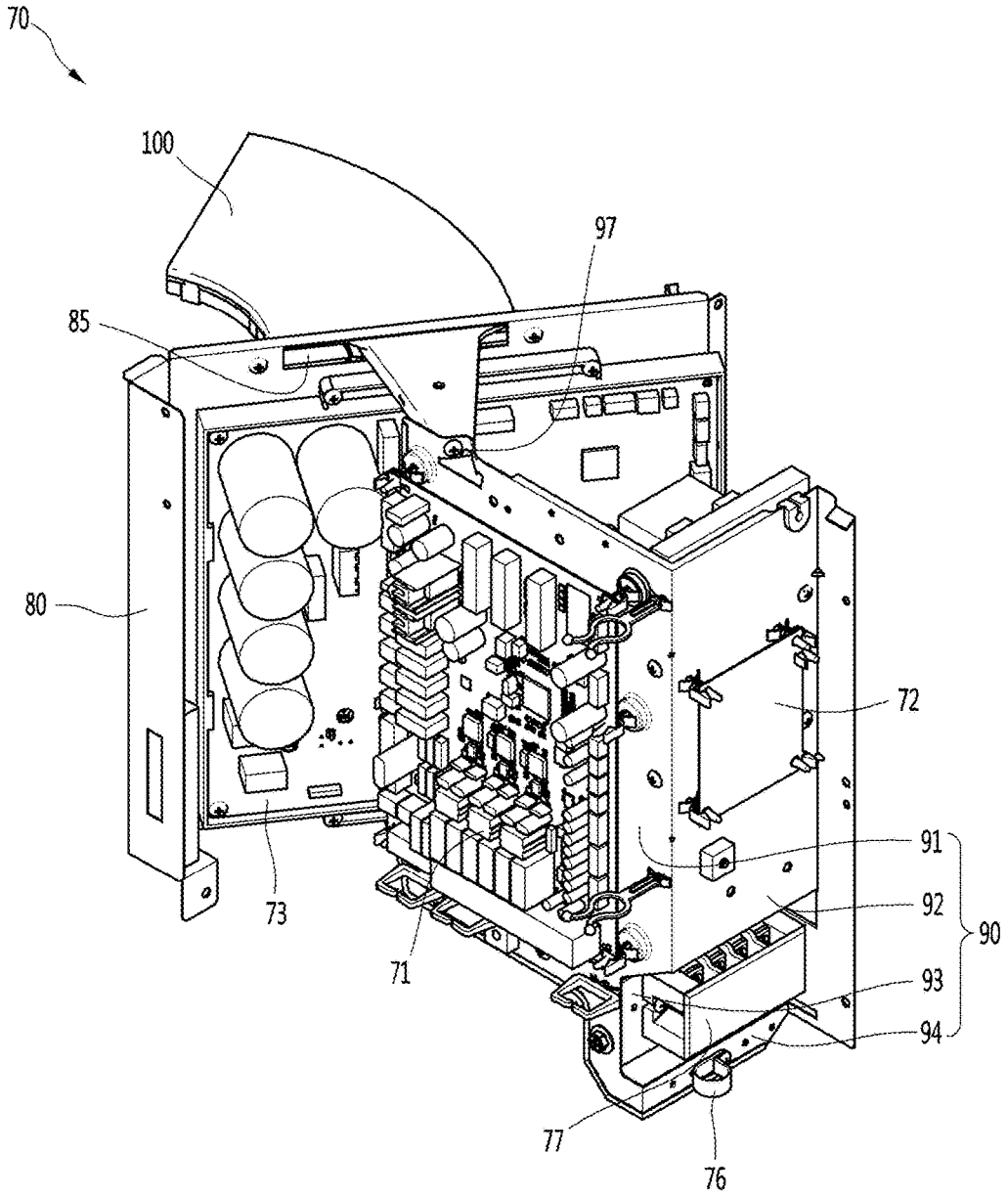
FIG. 5 is a front perspective view illustrating an electronic component part of the air conditioner according to an embodiment of the present disclosure.
Figure 6:
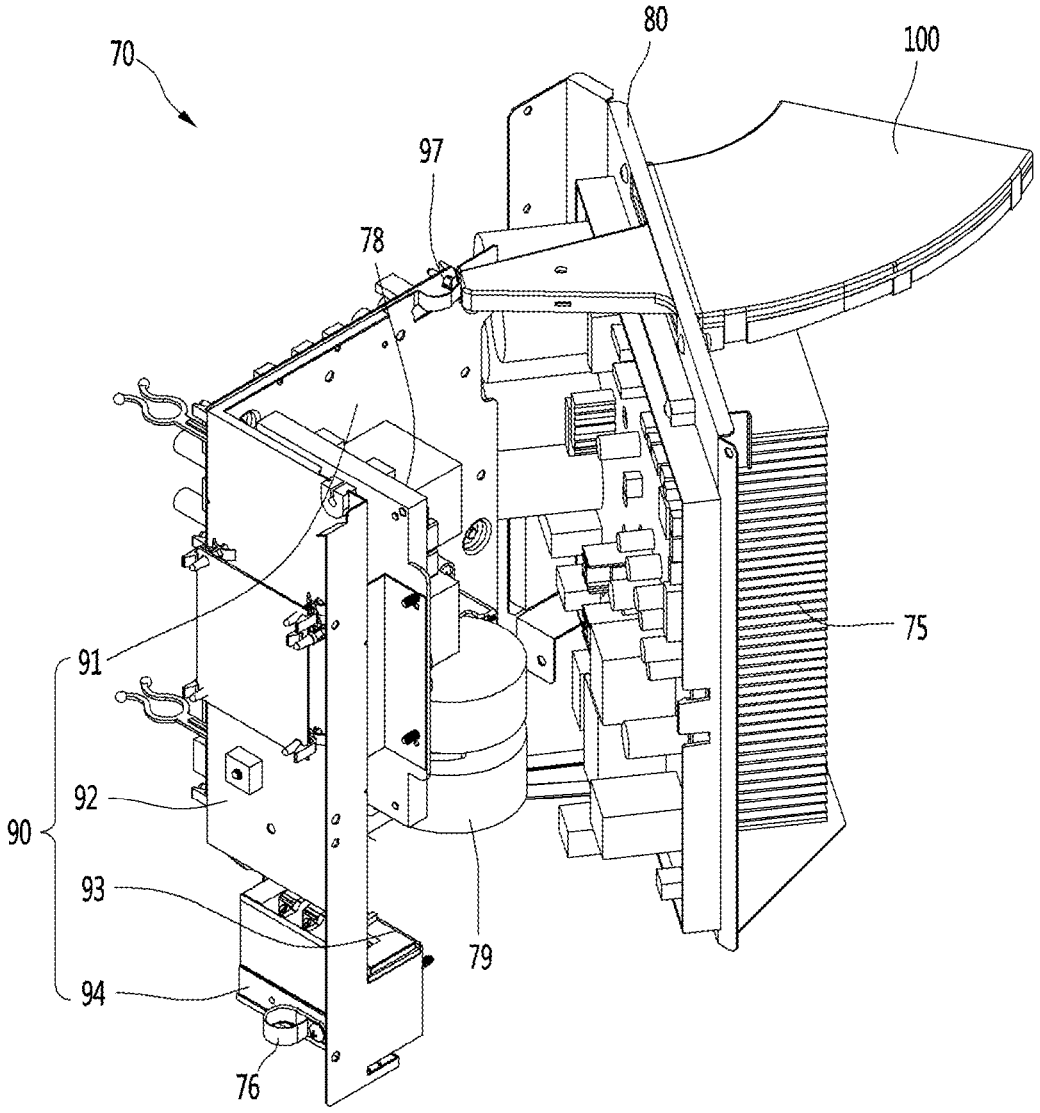
FIG. 6 is a rear perspective view of the electronic component part of the air conditioner according to an embodiment of the present disclosure.

FIG. 5 is a front perspective view illustrating the electronic component part of the air conditioner according to the embodiment of the present disclosure, and FIG. 6 is a rear perspective view of the electronic component part of the air conditioner according to the embodiment of the present disclosure.

Referring to FIGS. 5 and 6, the electronic component part 70 may include a plurality of electronic components. For example, the electronic component part 70 may include at least one of a main PCB 71, the display PCB 72, an inverter PCB 73, a heat sink 75, a terminal block 77, a noise filter 78, and a reactor 79.

The electronic component part 70 may additionally include the first panel 80 at which the plurality of electronic components are attached, and a second panel 90 which is disposed to be spaced apart from the first panel 80.

The first panel 80 may be located at an upper side of the partition wall 18, and the partition wall 18 and the first panel 80 may divide the heat exchange chamber 50 and the electronic component chamber 60.

The inverter PCB 73 may be attached to a front surface of the first panel 80, and the heat sink 75 may be attached to a rear surface thereof. Here, the front surface is a surface which is adjacent to the electronic component chamber 60, and the rear surface is a surface which is adjacent to the heat exchange chamber 50.

Also, the inverter PCB 73 and the heat sink 75 may be attached to positions corresponding to each other based on the first panel 80. Thus, heat of the inverter PCB 73 may pass through the first panel 80, may be transferred to the heat sink 75, and then may be discharged.

For example, the inverter PCB 73 and the heat sink 75 may be attached at the same height as each other, and the heat sink 75 may be disposed at a rear surface of a point where the inverter PCB 73 is installed.

Also, although not illustrated in the drawings, a through part may be provided at the first panel 80, and a heat transfer plate which transfers the heat of the inverter PCB 73 to the heat sink 75 may pass through the through part.

The first panel 80 may also include a suction part 85. The suction part 85 may be located at an upper portion of the first panel 80, and may be an opening which passes through the first panel 80. For example, the suction part 85 may be located at an upper side further than the point to which the inverter PCB 73 is attached.

An introduction port 102 of the air guide 100 may be located at a rear surface of the suction part 85. The air in front of the suction part 85 may flow to the introduction port 102 of the air guide 100. The suction part 85 may be referred to as a "through part" because the air may pass through the suction part 85

The second panel 90 may include at least one of: a first plate 91 which is disposed to face the front panel 11; a second plate 92 which is bent from the first plate 91, then extends, and is located to face the service panel 16; a third plate 93 which is bent from the first plate 91, then extends, and is located under the second plate 92; and a fourth plate 94 which is bent from the first plate 91, then extends, and is located under the second and third plates 92 and 93.

The first plate 91 may be disposed in parallel with the front panel 11 or the rear panel 12. The second plate 92 may be disposed in parallel with the service panel 16. The third and fourth plates 93 and 94 may be disposed in parallel with the left panel 14 or the right panel 15.

The second, third and fourth plates 92, 93 and 94 may be formed to be spaced apart from each other in an upward and downward direction. Here, the upward and downward direction is a direction which is directed from the base 17 toward the upper surface panel 13 or a direction which is directed from the upper surface panel 13 toward the base 17.

For example, the second, third, and fourth plates 92, 93 and 94 may be formed to be spaced apart from each other in an order of the second plate 92, the third plate 93, and the fourth plate 94 from an upper side toward a lower side.

Also, the second, third, and fourth plates 92, 93 and 94 may be formed to be spaced apart from each other in a left and right direction. Here, the left and right direction is a direction which is directed from the right panel 15 toward the left panel 14, or a direction which is directed from the left panel 14 toward the right panel 15.

For example, among the second, third, and fourth plates 92, 93 and 94, the second plate 92 may be disposed closest to the right panel 15, and the third plate 93 may be disposed closest to the left panel 14, and the fourth plate 94 may be disposed between the second and third plates 92 and 93 to be spaced apart therefrom. That is, the second, third and fourth plates 92, 93 and 94 may be disposed to be spaced apart from each other in an order of the second plate 92, the fourth plate 94 and the third plate 93 from a right side toward a left side.

The main PCB 71 may be attached to a front surface of the first plate 91, and the reactor 79 may be attached to a rear surface thereof. The main PCB 71 and the reactor 79 may be alternately disposed.

For example, the main PCB 71 may be attached to an upper side of the front surface of the first plate 91, and the reactor 79 may be attached to a lower side of the rear surface of the first plate 91.

In such a configuration, because the air guide 100 discharges the air close to the rear surface of the first plate 91 to the heat exchange chamber 50, the heat generated from the reactor 79—which has a higher heat generation rate than the main PCB and is located at the rear surface of the first plate 91—is prevented from being transferred to the main PCB 71.

The display PCB 72 may be attached to a front surface of the second plate 92, and the noise filter 78 may be attached to a rear surface thereof.

The display PCB 72 may be disposed toward the service panel 16. More specifically, the display PCB 72 may be disposed toward the service window of the service panel 16 so that the display PCB 72 can be viewed from an outside of the outside unit 10 through the service window.

The terminal block 77 may be attached to a front surface of the third plate 93.

One end of a power cable or a signal cable which is connected from the outside of the outside unit 10 to an inside thereof is attached to the terminal block 77. The terminal block 77 functions to distribute electric power or a signal to the electronic components installed at the electronic component part 70. The power cable or the signal cable may pass through among the second, third, and fourth plates 92, 93 and 94 which are spaced apart from each other, and may be connected to each of the electronic component parts 70.

A front surface of the fourth plate 94 includes a fixing member 76 to which a part of the power cable or the signal cable is fixed. The fixing member 76 may prevent the power cable or the signal cable attached to the terminal block 77 from being separated by an external force. The fixing member 76 may also prevent the power cable or the signal cable from being twisted inside the outside unit 10.

Figure 7:
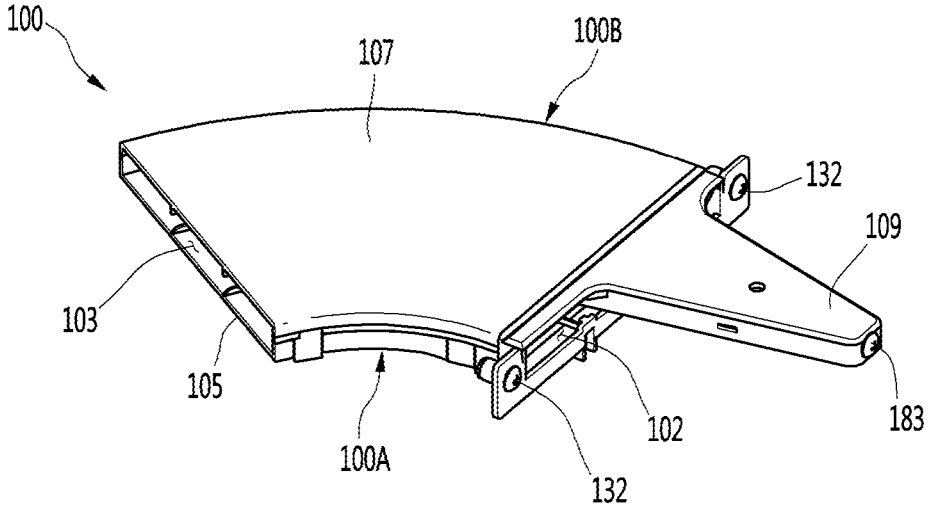
FIG. 7 is a perspective view of an air guide of the air conditioner according to an embodiment of the present disclosure.
Figure 8:
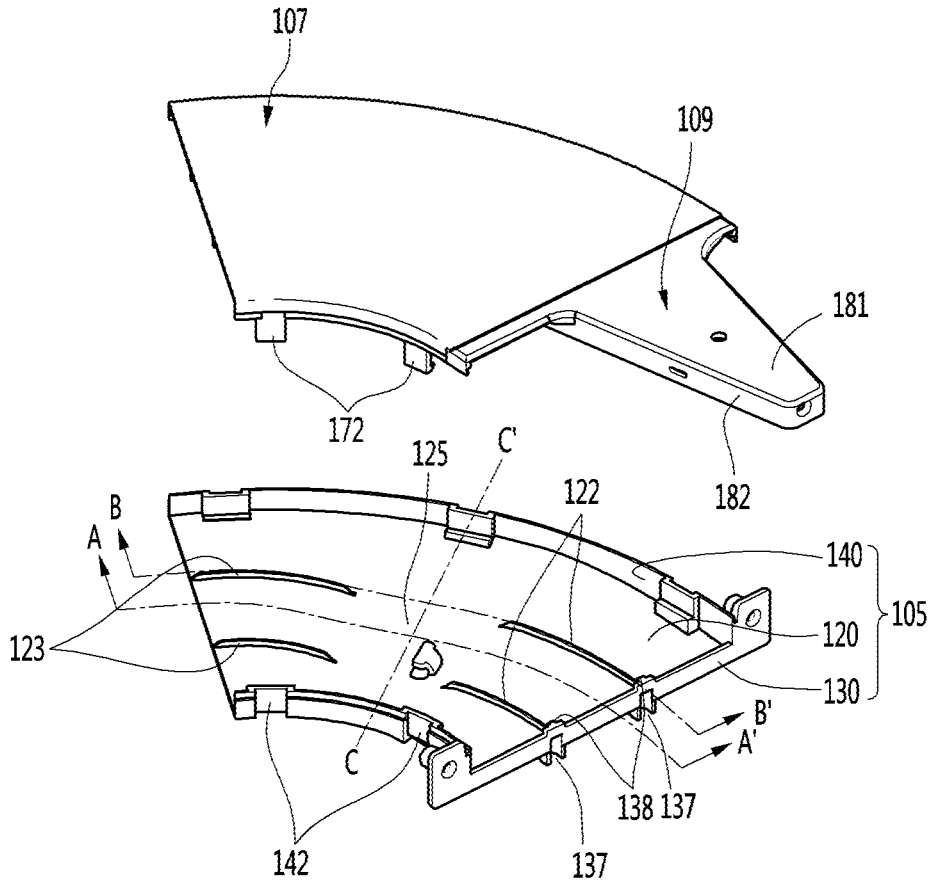
FIG. 8 is an exploded view of the air guide of the air conditioner according to an embodiment of the present disclosure.
Figure 9:
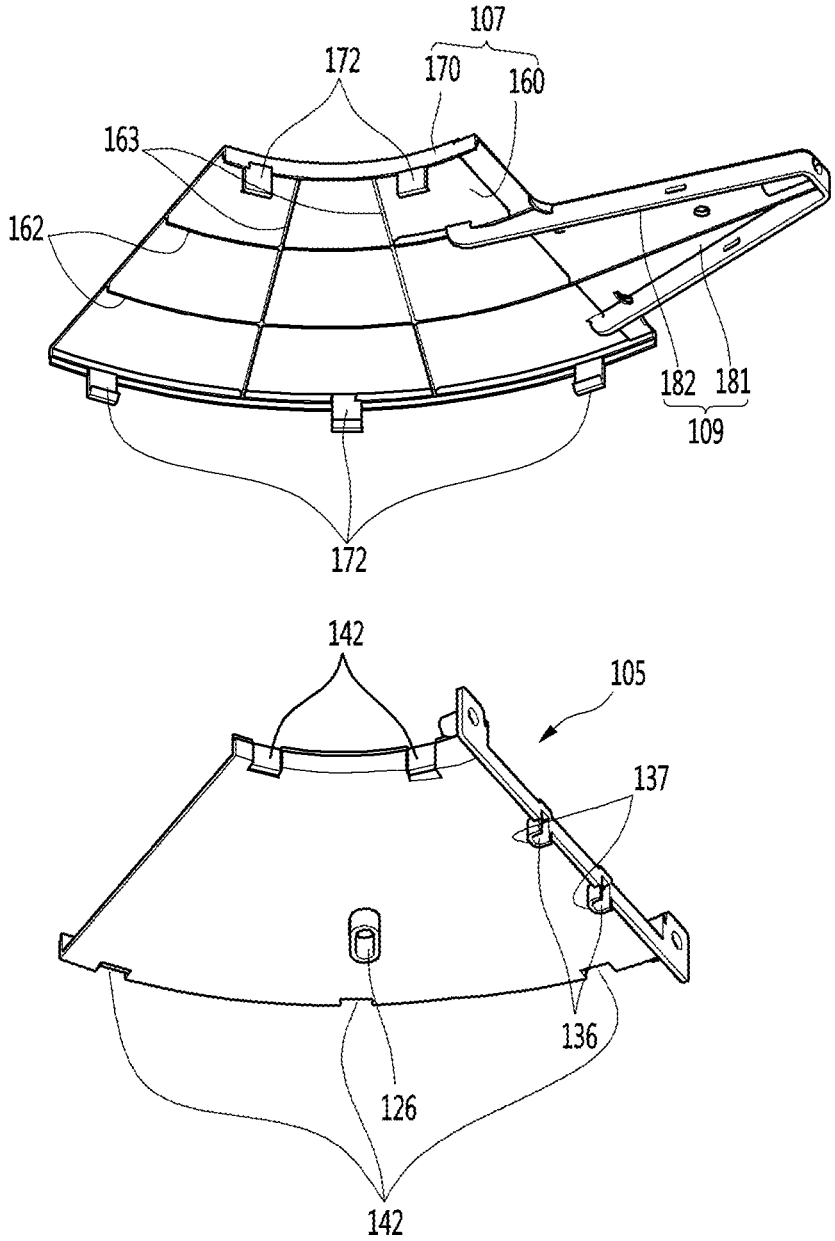
FIG. 9 is another exploded view of the air guide of the air conditioner according to an embodiment of the present disclosure
Figure 10:
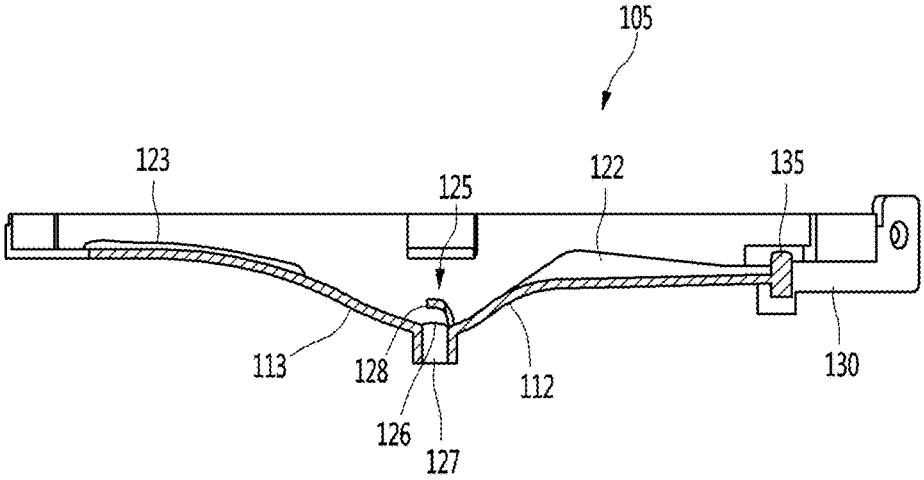
FIG. 10 is a cross-sectional view taken along line A-A' of FIG. 8.
Figure 11:
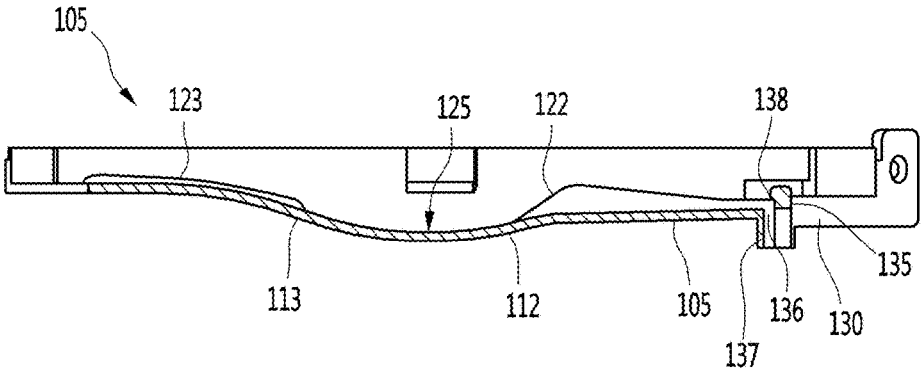
FIG. 11 is a cross-sectional view taken along line B-B' of FIG. 8.
Figure 12:
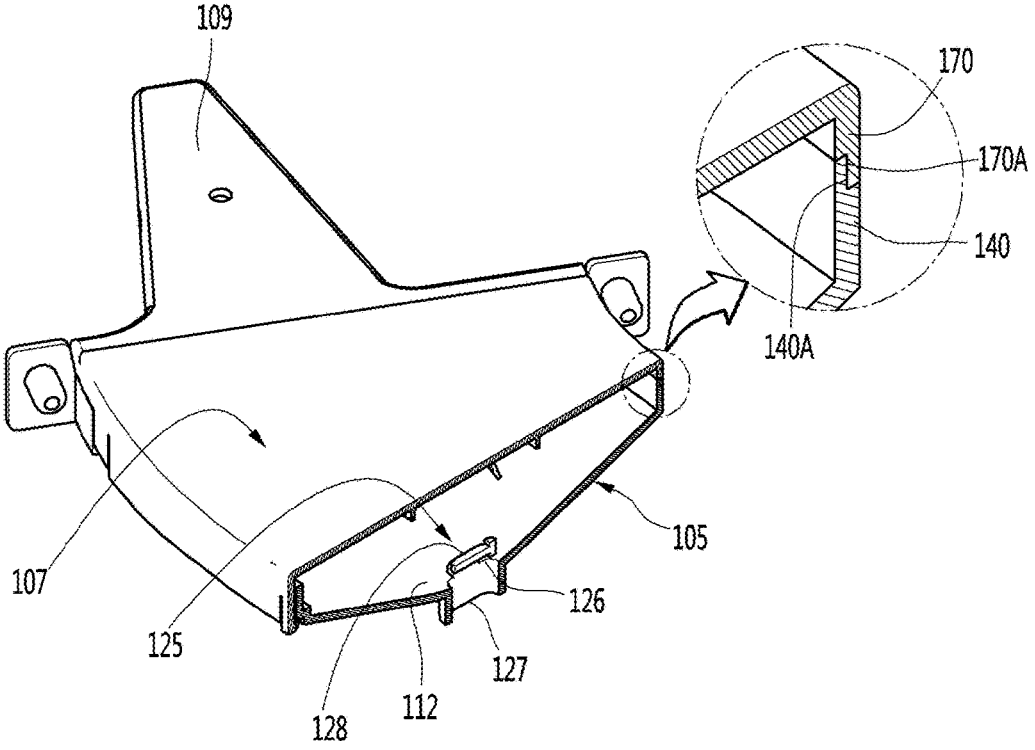
FIG. 12 is a cross-sectional view taken along line C-C' of FIG. 8.

FIG. 7 is a perspective view of the air guide of the air conditioner according to the embodiment of the present disclosure, FIGS. 8 and 9 are exploded views of the air guide of the air conditioner according to the embodiment of the present disclosure, FIG. 10 is a cross-sectional view taken along line A-A' of FIG. 8, FIG. 11 is a cross-sectional view taken along line B-B' of FIG. 8, and FIG. 12 is a cross-sectional view taken along line C-C' of FIG. 8.

As illustrated in FIGS. 7 through 12, the air conditioner includes the air guide 100. The air guide 100 may be attached to the first panel 80 and the second panel 90. The air guide 100 may discharge the air in the electronic component chamber 60 to the heat exchange chamber 50. The air guide 100 may also prevent water in the heat exchange chamber 50 from permeating into the electronic component chamber 60.

The air guide 100 may be simultaneously attached to the first panel 80 and the second panel 90, and may suction the air flowing around the first panel 80 and the second panel 90.

For example, the air guide 100 may be attached to both an upper side of a rear surface of the first panel 80 and an upper side 97 of a rear surface of the second panel 90, and may suction the air flowing between the front surface of the first panel 80 and the rear surface of the second panel 90.

A device which generates a large amount of heat may be attached to the front surface of the first panel 80 and the rear surfaces of the first and second plates 91 and 92. More specifically, for example, the inverter PCB 73 may be attached to the front surface of the first panel 80, the reactor 79 may be attached to the rear surface of the first plate 91, and the noise filter 78 may be attached to a rear surface of the second plate 92.

In such a configuration, because the air guide 100 suctions the air in a space between the front surface of the first panel 80 and the rear surfaces of the first and second plates 91 and 92, and then discharges the air to the heat exchange chamber 50, cooling efficiency may be enhanced by increasing the flow speed of the air around the inverter PCB 73, the noise filter 78 and the reactor 79 which each have a high heat generation rate.

The air guide 100 may extend from the electronic component chamber 60 toward the heat exchange chamber 50 and rounded with a predetermined curvature. Specifically, the air guide 100 may include an inner circumferential surface part 100A which extends having a first preset curvature, and an outer circumferential surface part 100B which is formed outside the inner circumferential surface part 100A and extends having a second preset curvature. The first preset curvature and the second curvature may be the same as each other.

By such configurations of the inner circumferential surface part 100A and the outer circumferential surface part 100B, a flow direction of the air introduced from the electronic component chamber 60 may be more efficiently switched to the heat exchange chamber 50. That is, due to a curved surface, friction with the air may be reduced, and the flow speed of the air may be maintained even when the direction of the air is switched or reversed.

Each of the inner circumferential surface part 100A and the outer circumferential surface part 1008 may be formed by coupling a first protruding part 140 of a base plate 105 and a second protruding part 170 of a cover plate 107 (described below).

The air guide 100 may include the base plate 105 and the cover plate 107. The base plate 105 may form a lower portion of the air guide 100, and the cover plate 107 may form an upper portion of the air guide 100.

Specifically, the base plate 105 and the cover plate 107 may be coupled together in the upward/downward direction, and an internal space through which the air flows may be formed between the base plate 105 and the cover plate 107, which are coupled together. The base plate 105 and the cover plate 107 together may be referred to as a "main body" of the air guide 100.

The air guide 100 may further include the introduction port 102 which is provided at one side thereof to introduce the air, and the discharge port 103 which is provided at the other side thereof to discharge the air. The air flows from the introduction port 102 toward the discharge port 103. Therefore, the introduction port 102 may be provided at a side of the electronic component chamber 60, and the discharge port 103 may be provided at a side of the heat exchange chamber 50.

The base plate 105 may have a "C-shape" which is opened upward, and may include a first guide surface 120 and the first protruding part 140. The first guide surface 120 may form an upper surface of the base plate 105, and may be located at a lower side of the internal space to guide the flow of the air. The first protruding part 140 may extend upward from both side ends of the first guide surface 120, and the cover plate 107 may be attached thereto.

The first guide surface 120 may include a water collection part 125. The water collection part 125 may store and discharge the water suctioned from the air guide 100, and thus prevent the water from permeating into the electronic component chamber 60.

The water collection part 125 may be formed by recessing downward the first guide surface 120, and may include inclined surfaces 112 and 113 which may be curved downward. The inclined surfaces 112 and 113 may be formed to be rounded and thus to minimize the friction with the air.

The inclined surfaces 112 and 113 may include a first inclined surface 112 which may extend from a lowermost side of the water collection part 125 toward the electronic component chamber 60, and a second inclined surface 113 which may extend from the lowermost side of the water collection part 125 toward the heat exchange chamber 50. The first inclined surface 112 and the second inclined surface 113 may have different inclined angles from each other. For example, the first inclined surface 112 may be more sharply inclined than the second inclined surface 113.

In such a configuration, because the water stored in the water collection part 125 is introduced into the electronic component chamber 60 only when passing through the first inclined surface 112—which is sharply inclined—the water may be prevented from being introduced into the electronic component chamber 60. However, because the air is guided by the second inclined surface 113 which is gently inclined (e.g., inclined less sharply than the first inclined surface), and flows to the heat exchange chamber 50, the friction of the air due to the water collection part 125 formed to be recessed may be minimized.

Also, the first guide surface 120 may include a first drainage hole 126 which is located at the lowermost side of the water collection part 125 to pass through the base plate 105. The first drainage hole 126 may enable the water stored in the water collection part 125 to be discharged to a lower side of the air guide 100. The water which falls downward may fall on the base 17. The water collection part 125 may be formed in an elliptical shape, but is not limited thereto.

Also, the first guide surface 120 may further include a first drainage pipe 127 which extends downward from the drainage hole 126. The first drainage pipe 127 may introduce the air in the heat exchange chamber 50 into the first drainage hole 126, and thus may prevent the water stored in the water collection part 125 from being discharged.

Also, the first guide surface 120 may further include a first protrusion 128. The first protrusion 128 may be bent and extend from one side of the first drainage hole 126 to an upper space of the first drainage hole 126. For example, the first protrusion 128 may be bent and extend upward from a front of the first drainage hole 126, spaced toward an upper side of the first drainage hole 126, and have the same size as that of the first drainage hole 126.

The first protrusion 128 may guide the water in the water collection part 125 to the first drainage hole 126. The first protrusion 128 may also prevent the air flowing along the first guide surface 120 from flowing toward the first drainage hole 126.

Such configuration may prevent the water stored close to the first drainage hole 126 from flowing to a space other than the first drainage hole 126 due to the air. Such configuration may also enable the water to smoothly flow from the water collection part 125 toward the first drainage hole 126.

Since the first drainage hole 126, the first drainage pipe 127 and the first protrusion 128 are located near the water collection part 125, they may be referred to as a "drainage hole of the water collection part," a "drainage pipe of the water collection part," and a "protrusion of the water collection part."

The first guide surface 120 may further include ribs 122 and 123 which guide the air. A plurality of ribs 122 and 123 may be formed in a flowing direction of the air and spaced apart from each other in parallel.

The number of ribs and a height of each of the ribs may vary depending on a size and a shape of a flowing space of the air. For example, where the air guide 100 is bent with a predetermined curvature, each of the ribs may be bent with the same predetermined curvature.

For example, the ribs 122 and 123 may include a first rib 122 which extends forward based on the water collection part 125, and a second rib 123 which extends backward based on the water collection part 125. However, the ribs may not be formed in the water collection part 125. It is understood here that the term "forward" is a direction toward the introduction port 102, and the term "backward" is a direction toward the discharge port 103.

Due to such a configuration, the water stored in the water collection part 125 may smoothly flow to the first drainage hole 126 located at the lowermost side of the water collection part 125 without interference with the ribs 122 and 123.

The base plate 105 may further include a coupling surface 130. The coupling surface 130 is formed to be bent from one side of the base plate 105 toward an outside thereof, and is in contact with the first panel 80. Here, a direction toward an internal space formed by the base plate 105 and the cover plate 107 may be referred to an inside, and a direction toward an external space may be referred to as an outside.

A blocking wall 135 which restricts a flow of the water is provided at the coupling surface 130. The blocking wall 135 extends from the coupling surface 130 by a predetermined length in a direction that the cover plate 107 is coupled, i.e., upward in FIG. 8. Therefore, the introduction port 102 may be formed at an upper side of the blocking wall 135. Specifically, the introduction port 102 may be located between the blocking wall 135 and a second guide surface 160 of the cover plate 107 which will be described later.

The blocking wall 135 is formed to have at least a predetermined height to prevent water from flowing along the first guide surface 120 to a front of the coupling surface 130. Accordingly, the air flows to an upper side of the blocking wall 135, and thus is introduced into an internal space of the air guide 100, but the water is prevented by the blocking wall 135 from flowing to a front of the air guide 100.

The coupling surface 130 may further include a second drainage hole 136 which passes through the base plate 105. The second drainage hole 136 may be located at one side of the blocking wall 135. For example, the second drainage hole 136 may be formed close to a rear surface of the blocking wall 135. As such, the water discharged through the second drainage hole 136 may flow along the rear surface of the first panel 80 and one surface of the partition wall 18, and fall on the upper surface of the base 17. Such configuration prevents the water from flowing to the electronic component chamber 60.

The coupling surface 130 may further include a second drainage pipe 137 which extends downward from the second drainage hole 136. The second drainage pipe 137 may prevent the water from flowing backward to the second drainage hole 136 due to the flow of the air in the heat exchange chamber 50.

The coupling surface 130 may further include a second protrusion 138 which extends from one side of the blocking wall 135 toward an upper side of the second drainage hole 136. According to an embodiment, the second protrusion 138 may extend backward from an upper end of the blocking wall 135, and have a size corresponding to that of the second drainage hole 136. The second protrusion 138 may be provided above the second drainage hole 136 such that it is spaced apart from the second drainage hole 136.

The second protrusion 138 may prevent the air from flowing toward the second drainage hole 136, and thus may prevent the water located close to the second drainage hole 136 from flowing to a space other than the second drainage hole 136 due to the air.

Here, because the second drainage hole 136, the second drainage pipe 137, and the second protrusion 138 are located close to the blocking wall 135, they may be referred to as a "drainage hole of the blocking wall," a "drainage pipe of the blocking wall" and a "protrusion of the blocking wall."

The coupling surface 130 may include a first fastening part 132. A plurality of first fastening parts 132 may be provided at both sides of the introduction port 102 and arranged to be symmetrical with respect to the introduction port 102. The first fastening part 132 enables the coupling surface 130 to be in contact with the rear surface of the first panel 80. At this point, the introduction port 102 may be in communication with the electronic component chamber 60. That is, the introduction port 102 may be located corresponding to the suction part 85.

The first protruding part 140 may include an installation groove 142 which is provided at an outside. An installation rib 182 provided at the second protruding part 170 may be attached to the installation groove 142, and thus the base plate 105 and the cover plate 107 may be attached to each other.

The cover plate 107 may be formed in a "C-shape" which is opened downward, and may include the second guide surface 160 and the second protruding part 170.

The second guide surface 160 may form a lower surface of the cover plate 107, and be located at an upper side of the internal space to guide the flow of the air. The second protruding part 170 may protrude downward from both side ends of the second guide surface 160, and may be attached to the base plate 105. The second protruding part 170 may include the installation rib 182 which is attached to the installation groove 142.

A lower surface of the second guide surface 160 may include a third rib 162 which guides the air, and a fourth rib 163 which restricts a flow of the water. A plurality of third ribs 162 may be formed in the same direction as that of the first and second ribs 122 and 123, i.e., a flowing direction of the air so as to be spaced apart from each other in parallel. For example, in the case in which the air guide 100 is bent with the predetermined curvature, each of the ribs may be bent with the same predetermined curvature, like the shape of the air guide 100.

Also, the third rib 162 may continuously extend from the introduction port 102 to the discharge port 103, but is not limited thereto. The third rib 162 may extend from a lower surface of a fixing plate 109 to the discharge port 103. That is, the third rib 162 may be provided at the fixing plate 109 which is located forward further than the introduction port 102.

The fourth rib 163 may restrict movement of water drops formed on the lower surface of the second guide surface 160. The fourth rib 163 may be formed in a direction which crosses the flowing direction of the air. Therefore, the fourth rib 163 may be formed in a direction which crosses the first, second, and third ribs 122, 123, and 162.

The fourth rib 163 may be formed in a radial shape when the air guide 100 is formed to be bent with the predetermined curvature. That is, the fourth rib 163 may extend from the inner circumferential surface part 100A to the outer circumferential surface part 1008, and a plurality of fourth ribs 163 may be provided.

In such configuration, a distance between points at which the plurality of fourth ribs 163 are coupled to the outer circumferential surface part 1008 is larger than that between points at which the plurality of fourth ribs 163 are coupled to the inner circumferential surface part 100A. Therefore, in such configuration, the plurality of fourth ribs 163 extend radially from the inner circumferential surface part 100A to the outer circumferential surface part 100B, and may extend so that a distance therebetween is gradually increased.

The water formed on the fourth ribs 163 may fall down by the flow of the air, and the fallen water may be discharged to a lower side of the air guide 100 through the water collection part 125 of the base plate 105.

The air guide 100 may include the fixing plate 109 which extends forward from the cover plate 107. The fixing plate 109 may function to fix the air guide 100 to the first panel 80 and the second panel 90. More specifically, the fixing plate 109 may pass through the suction part 85 of the first panel 80, and be attached to one side 97 of the second panel 90. At this point, the suction part 85 may be formed corresponding to a size of the introduction port 102. For example, the fixing plate 109 may pass through a part of the suction part 85, and the remaining part of the suction part 85 through which the fixing plate 109 does not pass may be in communication with the introduction port 102.

Due to such configuration, the air guide 100 may be attached to not only the first panel 80 but also to the second panel 90, and thus may be stably supported. Also, the introduction port 102 may suction the air between the first panel 80 and the second panel 90.

The fixing plate 109 may include an extending surface 181 which extends forward from a front end of the cover plate 107. That is, the extending surface 181 may extend forward from an upper side of the introduction port 102. For example, the extending surface 181 may extend in a triangular shape when viewed from above.

The fixing plate 109 may include a reinforcing surface 182 which is bent and extends downward from an end of the extending surface 181. The reinforcing surface 182 may also extend to the lower surface of the second guide surface 160. In such a configuration, the fixing plate 109 may have a "C-shape" which is opened downward, and the extending surface 181 may be formed to have a predetermined level of strength or more, and thus the fixing plate 109 may be prevented from being bent or broken to one side.

The fixing plate 109 may include a second fastening groove 183 which enables the air guide 100 to be attached to the one side 97 of the second panel 90.

The second protruding part 170 may be formed to correspond or be matched with the first protruding part 140 of the base plate 105. Thus, the first protruding part 140 and the second protruding part 170 may form the inner circumferential surface part 100A or the outer circumferential surface part 1008 of the air guide 100.

For example, the first protruding part 140 and the second protruding part 170 may be coupled so that an inner circumferential surface 140A of the first protruding part 140 contacts an outer circumferential surface 170A of the second protruding part 170. That is, the first protruding part 140 and the second protruding part 170 may be attached so that the inner circumferential surface 140A of the first protruding part 140 contacts the outer circumferential surface 170A of the second protruding part 170.

According to such a configuration, the cover plate 107 surrounds the base plate 105. Thus, because a coupling surface between the cover plate 107 and the base plate 105 is disposed vertical relative to the ground, the water may be prevented from permeating through a side surface of the air guide 100.

Figure 13:
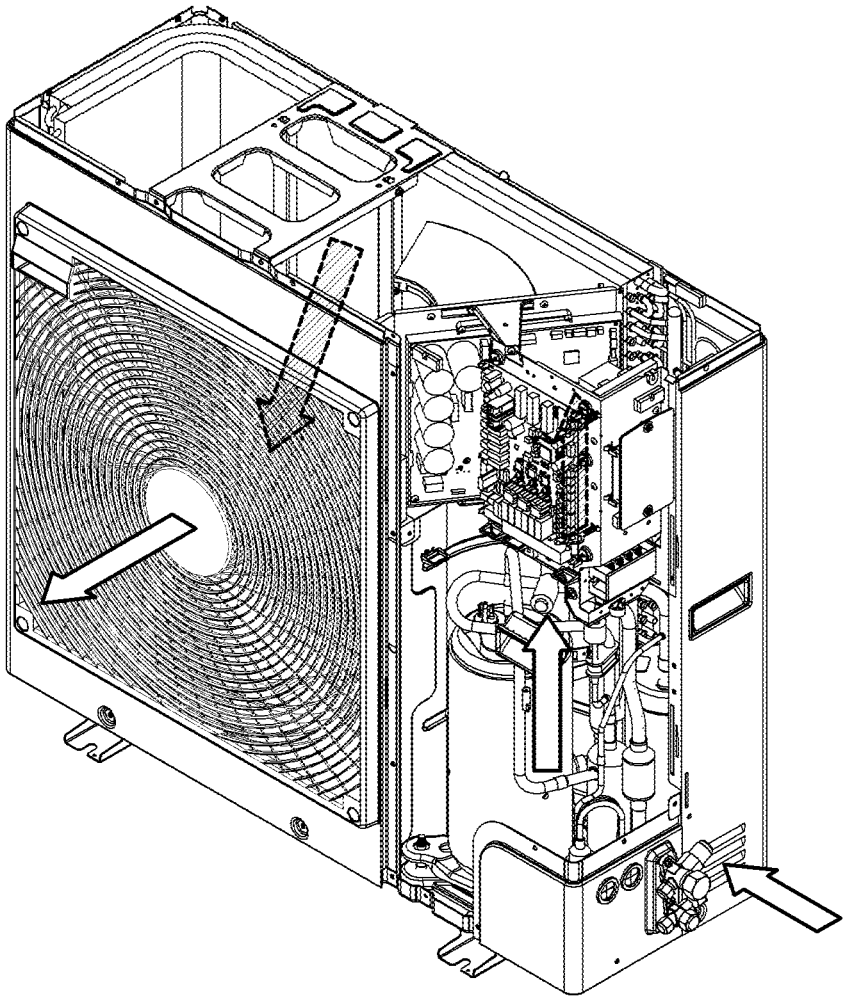
FIG. 13 is a view illustrating the flow of the air at an inside of the air conditioner according to an embodiment of the present disclosure.
Figure 14:
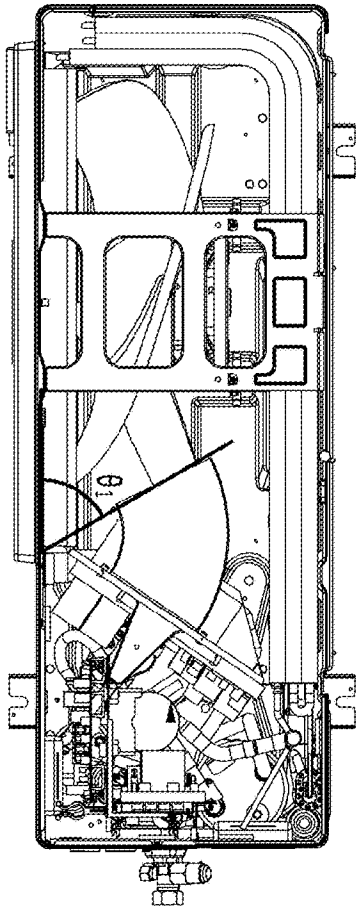
FIG. 14 is a view indicating a set angle according to an embodiment of the present disclosure.
Figure 15A:
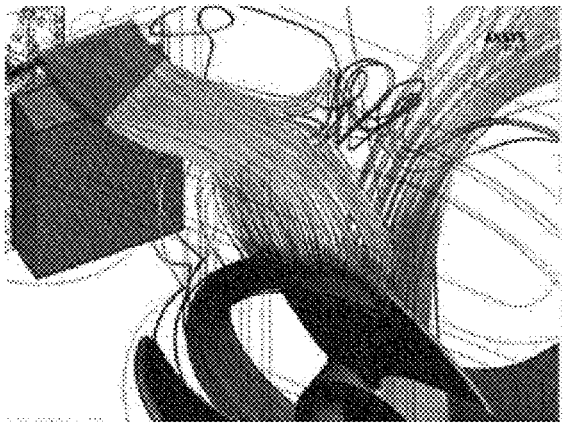
FIG. 15(A) is a view illustrating the flow of the air with respect to the set angle corresponding to test results (A) shown in Table 1 according to an embodiment of the present disclosure.
Figure 15B:
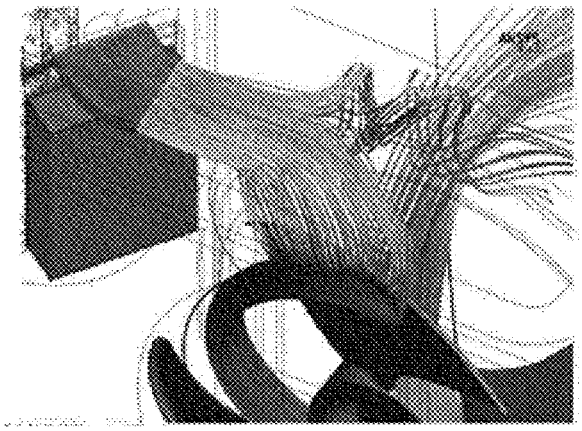
FIG. 15(B) is a view illustrating the flow of the air with respect to the set angle corresponding to test results (B) shown in Table 1 according to an embodiment of the present disclosure.
Figure 15C:
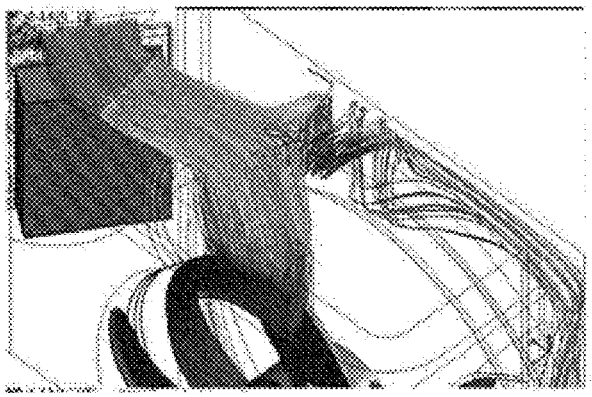
FIG. 15(C) is a view illustrating the flow of the air with respect to the set angle corresponding to test results (C) shown in Table 1 according to an embodiment of the present disclosure.
Figure 15D:
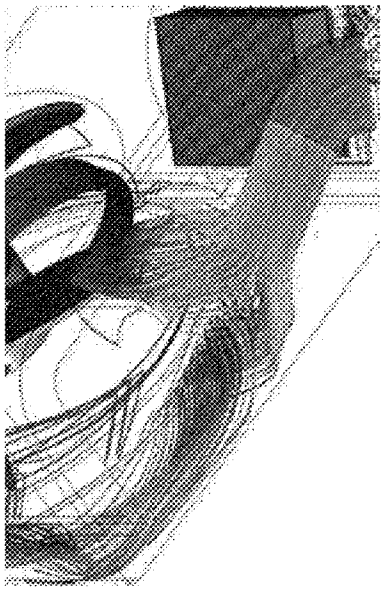
FIG. 15(D) is a view illustrating the flow of the air with respect to the set angle corresponding to test results (D) shown in Table 1 according to an embodiment of the present disclosure.
Figure 15E:
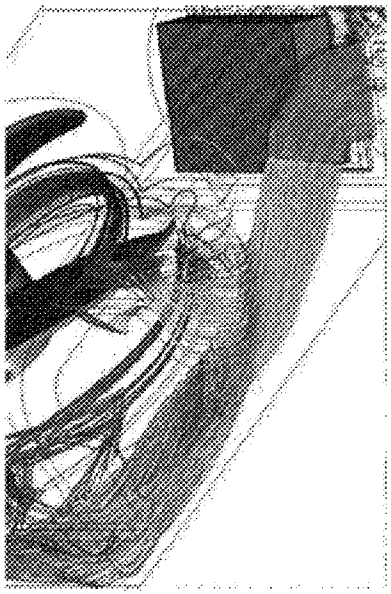
FIG. 15(E) is a view illustrating the flow of the air with respect to the set angle corresponding to test results (E) shown in Table 1 according to an embodiment of the present disclosure.
Figure 15F:
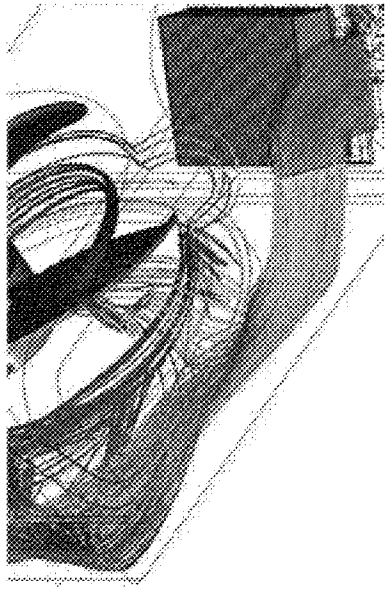
FIG. 15(F) is a view illustrating the flow of the air with respect to the set angle corresponding to test results (F) shown in Table 1 according to an embodiment of the present disclosure.

FIG. 13 is a view illustrating the flow of the air inside of the air conditioner according to the embodiment of the present disclosure, FIG. 14 is a view indicating a set angle according to the embodiment of the present disclosure, and FIG. 15 is a view illustrating the flow of the air with respect to the set angle according to the embodiment of the present disclosure.

Referring to FIGS. 13 through 15, the air conditioner may include a path in which the air is introduced through the suction port 15A of the right panel 15, cools the electronic component part 70, and then flows to the discharge port 11A of the front panel 11. Specifically, as shown, the external air may be introduced into the electronic component chamber 60 through the suction port 15A located at a lower side of the right panel 15. The air introduced into the electronic component chamber 60 may then flow in an upward direction. The air flowing upward functions to cool the plurality of electronic components disposed at the first panel 80 and the second panel 90. That is, the air flowing upward may intensively cool the inverter PCB 73 located at the front surface of the first panel 80, and the reactor 79 and the noise filter 78 located at the rear surface of the second panel 90 which experience a high rate of heat generation.

The second panel 90 may guide the air flowing toward the fixing plate 109.

The air flowing between the front surface of the first panel 80 and the rear surface of the second panel 90 may be suctioned into the introduction port 102 of the air guide 100, pass through the discharge port 103, and discharge to an upper side of the heat exchange chamber 50. The air flowed to the heat exchange chamber 50 flows to a front of the outside unit through the discharge port 11A of the outside unit by the fan 32.

The speed of the air discharged from the discharge port 103 and temperature of the reactor 79 vary according to a discharge angle of the air discharged from the discharge port 103 of the air guide 100.

TABLE 1

| | (A) | (B) | (C) | (D) | (E) | (F) |
|---|---|---|---|---|---|---|
| Set angle [deg] | 90 | 80 | 75 | 60 | 45 | 30 |
| Flowing speed [m/s] | 3.21 | 3.32 | 3.6 | 3.59 | 3.54 | 3.5 |
| Temperature of reactor [° C.] | 110.85 | 108.65 | 96.07 | 96.31 | 97.16 | 101.56 |

Table 1 and FIG. 15 indicate results of experiments which are performed while the set angle θ1 illustrated in FIG. 14 is varied. FIG. 14 illustrates the set angle θ1 between a first discharge surface which is provided at the discharge port 11A of the outside unit to discharge the air in the heat exchange chamber 50 and a second discharge surface which is provided at the discharge port 103 of the air guide 100 to discharge the air in the electronic component chamber 60. Table 1 indicates exemplar result values of the flowing speed of the air at the discharge port 103 and the temperature of the reactor 79 cooled by the air according to the set angle θ1.

When the set angle θ1 has a great value (e.g., 80° to 90°), the discharged air flows to the fan 32, and is discharged to the discharge port 11A of the outside unit 10. However, when the set angle θ1 has a small value (e.g., 30° or less), the discharged air does not flow to a periphery of the fan 32, but flows to an upper side of the front panel 11, and is discharged to the discharge port 11A of the outside unit 10.

However, when the set angle θ1 is within a range of 45° to 75°, a portion of the air discharged from the discharge port 103 of the air guide 100 flows to the fan 32, and is discharged. The remaining portion of the air does not flow to the fan 32, but flows to the upper side of the front panel 11 and is discharged. As a result, the path through which the air flows is widened, and thus the flowing speed of the air is increased, and the temperature of the reactor 79 may be further reduced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case comprising a heat exchange chamber and an electronic component chamber formed at a side of the heat exchange chamber, the electronic component chamber having an electronic component part disposed therein;

a suction port provided at the case and through which air that is external to the air conditioner is introduced inside the case; and an air guide attached to the electronic component part to guide the air introduced through the suction port from the electronic component chamber to the heat exchange chamber, wherein the air guide comprises:

a guide body to form an air path, a water collection part provided at a lower portion of the guide body to store water introduced into the guide body, and a drainage hole provided at the water collection part to discharge the water, wherein the guide body comprises:

a base plate at which the water collection part is formed, a cover plate which is attached to an upper side of the base plate, and a fixing plate which extends from the cover plate in a direction toward the electronic component chamber, wherein the electronic component part comprises:

a first panel dividing the heat exchange chamber and the electronic component chamber, and having a through part, a second panel which is arranged in a direction that intersects with the first panel, and wherein the fixing plate passes through the through part of the first panel, and is attached to the second panel, wherein the base plate is attached to the cover plate to form the air path, whereby the air path comprises an introduction port which is formed adjacent the electronic component chamber and a discharge port which is formed adjacent the heat exchange chamber, wherein the base plate and the cover plate are disposed in the heat exchange chamber.

2. The air conditioner of claim 1, wherein the suction port is formed at one side of a lower portion of the electronic component chamber, and the second panel of the electronic component part guides the air introduced through the suction port such that the air flows in an upward direction toward the fixing plate.

3. The air conditioner of claim 1, wherein the water collection part comprises:

a first inclined surface which extends from the drainage hole of the water collection part in a direction toward the electronic component chamber, and a second inclined surface which extends from the drainage hole of the water collection part in a direction toward the heat exchange chamber, whereby the slope of the first inclined surface is greater than the slope of the second inclined surface.

4. The air conditioner of claim 1, wherein the water collection part comprises:

a protrusion part which is bent and extends from one side of the drainage hole of the water collection part in a direction toward an upper side of the drainage hole of the water collection part, whereby the protrusion part guides the water stored in the water collection part to the drainage hole of the water collection part.

5. The air conditioner of claim 1, wherein the water collection part comprises:

a discharge pipe which extends from the drainage hole of the water collection part in a downward direction, whereby the water stored in the water collection part is discharged through the discharge pipe to the heat exchange chamber.

6. The air conditioner of claim 1, further comprising:

a partition wall provided between the electronic component chamber and the heat exchange chamber, wherein the air guide is provided at an upper side of the partition wall.

7. The air conditioner of claim 6, wherein the cover plate comprises a rib which is formed at a lower surface thereof and extends in a downward direction which intersects with a flowing direction of air, whereby the rib restricts the flow of water formed on a lower surface of the base plate.

8. The air conditioner of claim 1, further comprising:

an outside unit discharge port which is provided at the case and forms a first discharge surface for discharging air in the heat exchange chamber; and an air guide discharge port which is provided at the air guide and forms a second discharge surface for discharging air in the electronic component chamber, wherein the first discharge surface and the second discharge surface intersect at a preset angle.

9. The air conditioner of claim 8, wherein the preset angle is 45° to 70° .

10. The air conditioner of claim 1, further comprising:

a first protruding part which extends from both side ends of the base plate in an upward direction; and a second protruding part which extends from both side ends of the cover plate in a downward direction, wherein the second protruding part is in contact with and coupled to the first protruding part.

11. The air conditioner of claim 10, wherein an outer surface of the first protruding part is in contact with and attached to an inner surface of the second protruding part.

12. The air conditioner of claim 10, further comprising:

an installation rib which extends from a lower end of the first protruding part in a downward direction; and an installation groove which is provided at an outer circumferential surface of the second protruding part, wherein the installation rib attaches to the installation groove.

13. The air conditioner of claim 1, wherein the base plate further comprises a blocking wall which extends from the introduction port of the base plate in an upward direction, whereby the blocking wall prevents water from flowing to the introduction port.

14. The air conditioner of claim 13, wherein the blocking wall comprises a drainage hole formed at one side thereof and passes through the base plate, whereby the blocking wall guides water located on the upper surface of the base plate so that the water is discharged through the drainage hole.

15. The air conditioner of claim 14, wherein the blocking wall further comprises a protrusion part which extends in a direction toward a space above the drainage hole.

16. The air conditioner of claim 14, wherein the blocking wall further comprises a discharge pipe which extends from the drainage hole in a downward direction, whereby water that is restricted by the blocking wall is discharged to the heat exchange chamber through the discharge pipe.

* * * * *